United States Patent [19]

Maitland et al.

[11] Patent Number: 4,698,546

[45] Date of Patent: Oct. 6, 1987

[54] APPARATUS FOR FORMING ELECTRON BEAMS

[75] Inventors: Arthur Maitland, Fife, Scotland; Hugh Menown, Chelmsford, England; Ian A. Strudwick, Chelmsford, England; Clifford R. Weatherup, Chelmsford, England; Robert J. Carman, Fife, Scotland

[73] Assignee: English Electric Valve Company Limited, Chelmsford, United Kingdom

[21] Appl. No.: 683,035

[22] Filed: Dec. 18, 1984

[30] Foreign Application Priority Data

| | | | |
|---|---|---|---|
| Dec. 20, 1983 | [GB] | United Kingdom | 8333879 |
| Dec. 20, 1983 | [GB] | United Kingdom | 8333880 |
| May 30, 1984 | [GB] | United Kingdom | 8413791 |
| Dec. 10, 1984 | [GB] | United Kingdom | 8431116 |

[51] Int. Cl.[4] ..... H01J 1/16; H01J 17/06; H01J 29/04

[52] U.S. Cl. ..... 313/446; 313/574; 313/581; 313/618; 313/632; 313/339

[58] Field of Search ..... 313/310, 339, 340, 446, 313/450, 460, 574, 618, 629, 632, 346 R, 346 DC, 581, 582

[56] References Cited

U.S. PATENT DOCUMENTS

| | | | |
|---|---|---|---|
| 3,013,171 | 12/1961 | Beck | 313/82 |
| 3,967,150 | 6/1976 | Lien et al. | 313/338 |
| 4,123,687 | 10/1978 | Poirier et al. | 313/484 |
| 4,196,938 | 4/1980 | Lunev et al. | 313/32 |
| 4,527,090 | 7/1985 | Menown et al. | 313/340 X |

FOREIGN PATENT DOCUMENTS

| | | | |
|---|---|---|---|
| 0024656 | 3/1981 | European Pat. Off. . | |
| 57-69645 | 4/1982 | Japan . | |
| 57-119436 | 7/1982 | Japan . | |
| 57-208040 | 12/1982 | Japan . | |
| 603088 | 6/1948 | United Kingdom . | |
| 763670 | 12/1956 | United Kingdom . | |
| 1031319 | 6/1966 | United Kingdom . | |
| 1136144 | 12/1968 | United Kingdom . | |
| 1357535 | 6/1974 | United Kingdom | 313/618 |
| 1370656 | 10/1974 | United Kingdom . | |
| 1404897 | 9/1975 | United Kingdom . | |
| 1490463 | 11/1977 | United Kingdom . | |
| 1557094 | 12/1979 | United Kingdom . | |
| 2023922 | 1/1980 | United Kingdom . | |
| 2105102 | 3/1983 | United Kingdom . | |
| 2117173A | 10/1983 | United Kingdom . | |

*Primary Examiner*—David K. Moore
*Assistant Examiner*—K. Wieder
*Attorney, Agent, or Firm*—Spencer & Frank

[57] ABSTRACT

The present invention provides apparatus for forming electron beams, which may be advantageously employed in many applications, for example in display devices or thyratrons. A cathode member has a hole in its front surface. All the surfaces of the cathode member, except for the wall and base of the holes, are covered in an electrically insulating material such as glass. The cathode member and an anode member are contained within an envelope which also contains a gas filling. On application of a suitably high voltage between the cathode and anode members an electron beam is formed extensive in a direction away from the hole. The anode member may be located behind the front surface of the cathode member, and an electron beam still forms in front of the front surface.

63 Claims, 27 Drawing Figures

APPARATUS FOR FORMING ELECTRON BEAMS

BACKGROUND OF THE INVENTION

This invention relates to apparatus for forming electron beams, and to apparatus requiring the formation of electron beams, such as, for example, display devices and thyratrons.

SUMMARY OF THE INVENTION

The present invention seeks to provide improved apparatus for forming electron beams.

According to a first aspect of the invention there is provided apparatus for forming an electron beam comprising, within an envelope, an anode member; a cathode member of electrically conductive material; and a gas filling, and wherein, except for part of a front surface of the cathode member, at least substantially the whole of the surface of the cathode member which would otherwise be exposed to the gas filling within the envelope is covered with an electrically insulating material; the whole arrangement being such that upon the application of a suitably high voltage between the anode member and the cathode member an electron beam is formed extensive in a direction away from the part of the front surface.

According to a second aspect of the invention there is provided apparatus for forming an electron beam comprising, within an envelope, an anode member; a cathode member of electrically conductive material and having a hole in a front surface thereof; and a gas filling, and wherein, except within the hole, at least substantially the whole of the surface of the cathode member which would otherwise be exposed to the gas filling within the envelope is covered with an electrically insulating material, the whole arrangement being such that upon the application of a suitably high voltage between the anode member and the cathode member an electron beam is formed extensive in a direction away from the hole.

According to a third aspect of the invention, the anode member is located in front of the front surface of the cathode member.

Preferably a control grid electrode is included through which operation the electron beam passes, enabling the intensity or energy of the electron beam to be modulated.

Preferably the apparatus includes a plurality of elongate cathode members arranged in a grid formation, and a plurality of elongate anode members arranged in a grid formation with the grid of anode members superimposed over the grid of cathode members, but spaced therefrom, with the anode members in crossing relationship with the cathode members to form a matrix, each of the cathode members having a series of holes entering into its surface facing the grid of anode members and each of the anode members having a series of holes passing therethrough, with each hole in an anode member aligned with a hole in a different one of the cathode members, and all surfaces of the cathode members, except for surfaces within the holes in the cathode members, which would otherwise be exposed to the gas filling are isolated therefrom by electrically insulating material, and the whole arrangement being such that by applying a high potential between one of the anode members and one of the cathode members an electron beam is formed at the crossing point of the last-mentioned two members, said electron beam being extensive in the space betwen the mouth of the hole in the cathode member at the crossing point and the anode member, the beam being arranged to penetrate through the corresponding hole in the addressed anode member.

It will be appreciated that by suitably addressing selected ones of the anode and cathode members, an electron beam may be created which, by varying the selection of anode and cathode members addressed, may be caused to be animated.

Preferably, insulating material is interposed between the grid of cathode members and said grid of anode members, which insulating material has passages therethrough aligned with the holes in said cathode and anode members whereby to permit communication between one cathode hole and the appropriate anode hole but impede communication between that cathode hole and any other anode hole.

Preferably, the last-mentioned interposed insulating material is provided in the form of a slab having holes extending between its major surfaces and forming the the passages.

A control grid electrode may be located on the side of the grid of anode members other than that on which the grid of cathode members is located, or alternatively, it may be located between the grid of cathode members and the grid of anode members, and where insulating material is interposed between the cathode and anode grids the control grid electrode may be embedded in the interposed insulating material.

The anode member may be to one side of the axis of the electron beam formed in operation, such that the beam passes by the anode. It has been found by the inventors that the electron beam may be formed along the axis of the hole even though the anode member is displaced to the side of its path.

According to a fourth aspect of the invention the anode member is located behind the front surface of the cathode member, and again in this configuration the electron beam may be formed along the axis of the hole, rather than along the shortest path between the anode and cathode members.

Preferably the anode member is co-axial with the cathode member. Preferably a grid is included through which in operation the electron beam passes, enabling it to be modulated in intensity or energy, although of course, this may be achieved by varying the high voltage between the anode and cathode members.

Preferably there are included a plurality of elongate anode members, each having apertures therein; and a plurality of stemmed cathode members, each having a hole in the front surface thereof and arranged such that its stem extends through one of the apertures, such that each anode member is located behind the front surfaces of cathode members whose stems pass through apertures in the anode member, whereby by applying a high potential between an anode member and one of the cathode members extending through an aperture therein an electron beam is formed extensive in a direction away from the hole in the one of the cathode members.

As previously described where the grid of anode members are located in front of the grid of cathode members, by addressing selected cathode and anode members an electron beam may be formed in a desired location, or number of such beams formed simultaneously if cathode members may be individually addressed.

Preferably a cathode member extending through an aperture in one anode member is electrically connected to another cathode member extending through an aperture in another anode member and also preferably a connector connecting two cathode members is spaced from the anode members by electrically insulating material.

Preferably where the apparatus in accordance with this invention is included in a display device a phosphor layer is included and is aranged so that when an electron beam is formed it impinges upon a spot upon the layer whereby to excite the same and preferably the envelope has a portion formed as a faceplate on the interior of which the phosphor layer is provided.

According to a feature of this invention a video signal reproducing apparatus includes apparatus as described above.

According to a feature of the invention in its third aspect a cathode ray tube apparatus comprises a plurality of elongate cathode members arranged in a grid formation, a plurality of elongate anode members arranged in a grid formation with the grid of anode members superimposed over the grid of cathode members, but spaced therefrom, with the anode members in crossing relationship with the cathode members to form a matrix, each of the cathode members having a plurality of holes entering into its surface facing the grid of anode members and each of the anode members having a plurality of holes passing therethrough, with each hole in an anode member aligned with a hole in a different one of the cathode members and, superimposed over the grid of anode members on the thereof remote from said grid of cathode members, a phosphor screen, the two grids being enclosed within an envelope having a gas filling from which all surfaces of the cathode members, except for surfaces within the holes in said cathode members, which would otherwise be exposed to the gas filling are isolated therefrom by electrically insulating material, and the whole arrangement being such that by applying a high potential between one of the anode members and one of the cathode members an electron beam is formed at the crossing point of the last-mentioned two members, said electron beam being extensive in the space between the mount of the hole in the cathode member at the crossing point and the anode member, said beam penetrating through the corresponding hole in the addressed anode member to impinge upon a spot upon the phosphor whereby to excite the same.

According to a fifth aspect of the invention the longitudinal axis of the hole is oblique to the normal of the front surface, and the electron beam is formed normal to said front surface of the hole. The inventors discovered that, when the hole is arranged with its longitudinal axis inclined to the normal of the front surface, an electron beam is not formed parallel to the aforesaid axis as might be expected but is in fact, surprisingly, formed in a direction normal to the front surface. Where in this specification the term "normal" is used, it should be taken to include "substantially normal". Apparatus utilising this principle may be useful where, for example, space is restricted and it would not be possible to employ a device in which the hole is arranged normal to the surface of the cathode. Also manufacture of the device is facilitated since only the direction of the front surface need by accurately machined.

Such apparatus may include a plurality of holes in the front surface, at least one of said holes having its longitudinal axis oblique to the normal of the front surface at that hole, such that upon the application of the suitably high voltage, electron beams are formed extensive normal to the front surface at and in a direction away from respective holes. Since the configuration of the front surface was found by the inventors to determine the direction of electron beams produced, a desired pattern of electron beams or concentration of electron beams may be achieved without costly machining. For example, if a plurality of beams which are mutually parallel are required the holes need not be drilled in precise relationship to each other, as might have been thought, as only the front surface need be made flat. Of course the front surface can be curved if more complex patterns are required, and because of leniency in the disposition of the holes the cathode member may be more conveniently shaped for a desired application.

According to a sixth aspect of the invention there is provided apparatus for forming electron beams comprising, within an envelope, an anode member; a cathode member of electrically conductive material having a front surface which is curved; and a gas filling, and wherein, except for a plurality of discrete parts of the front surface, at least substantially the whole of the surface of the cathode member which would otherwise be exposed to the gas filling within the envelope is covered with an electrically insulating material, the whole arrangement being such that upon the application of a suitably high voltage between the anode member and said cathode member electron beams are formed extensive normal to the front surface at and in a direction away from respective parts.

It is preferred that, where there are a plurality of electron beams formed, the front surface is curved such that they are focussed or concentrated at a point or small region. This is a particularly useful configuration providing apparatus suitable for inclusion in an electron beam welder, or as a point source of soft X-rays or incandescent black body radiation.

According to a seventh aspect of this invention there is included a layer of phosphor material on a viewable screen arranged such that upon the application of the suitably high voltage the electron beam impinges upon the phosphor layer and so excites the same.

According to a feature of the seventh aspect of this invention a display apparatus comprises, within an envelope, a layer of phosphor material on a viewable screen; remote from the phosphor layer, a metallic cathode member having a hole formed in a front surface thereof; between the cathode member and said phosphor layer, an apertured anode electrode; and a gas filling, and wherein, except within the hole, at least substantially the whole of the surface of the cathode member which would otherwise be exposed to the gas filling within the envelope is covered with an electrically insulating material, the whole arrangement being such that upon the application of a suitably high voltage between the anode member and said cathode member an electron beam is formed extensive in the space between the mouth of the hole in said cathode member and the anode member, and is arranged to penetrate through an aperture in the anode member to impinge upon the phosphor layer and so excite the same.

Preferably the envelope has a portion formed as a faceplate upon the inner surface of which the phosphor layer is provided.

The apparatus may include a modulating grid provided to affect the strength or intensity of the electron beam impinging upon the phosphor layer.

The modulating grid may be a perforated grid or gauze provided either between the anode member and the phosphor layer or between said anode member and the cathode member. In other embodiments of the invention the modulating grid comprises a ring grid provided within the mouth of the hole in said cathode member. In this last mentioned case preferably an electrical connection for the grid is taken out, in insulated fashion through the cathode member in a direction away from the anode member, i.e. through the base of the cathode member.

Where, as is preferable, electrical connection to the cathode member is provided for by means of an electrical connector connected to the base of the cathode member, the last mentioned connector is preferably in the form of a hollow cylinder with an electrical connector for the grid passing, in insulated fashion, therethrough.

There may be provided a single hole in the cathode member with a corresponding single aperture in the anode member, but alternatively a plurality of holes may be provided in the cathode member with a corresponding plurality of holes in the anode member. Where a plurality of holes and apertures are provided these may be in ring formation, with or without a centrally disposed hole and aperture.

According to a feature of the second aspect of the invention thyratron apparatus comprises, within an envelope, an anode member; a cathode member of electrically conductive material and having a hole in a front surface thereof; and a gas filling, and wherein, except within the hole, at least substantially the whole of the surface of the cathode member which would otherwise be exposed to the gas filling within the envelope is covered with an electrically insulating material, the whole arrangement being such that upon the application of suitably high voltage between the anode member and the cathode member an electron beam is formed extensive in a direction away from the hole.

Preferably the cathode member has a plurality of holes in the front surface thereof, such that upon application of a suitably high voltage, electron beams are formed extensive in a direction away from respective holes, and it is preferred that the front surface is curved, such that some focussing of the electron beams to a point may be obtained. Also it is preferred, where the front surface is curved, that at least one of the holes has its longitudinal axis oblique to the normal of the front surface at that hole. The cathode member may form the cathode of a thyratron, or advantageously thermionic material may be included and arranged such that when an electron beam or beams are formed they heat the same. This heating may be direct or indirect. For example, a substrate carrying the thermionic material may be exposed to the electron beam or beams and heat transmitted to the thermionic material by conduction.

Alternatively, when the electron beam is formed, it may be arranged to ionize the gas filling in a localised region, and so improve operating characteristics of a thyratron, and advantageously the longitudinal axis of the hole is oblique to the normal of the front surface at the hole, enabling the cathode member to be accommodated in a restricted space. Of course, more than one such cathode member may be employed.

According to an eighth aspect of the invention the front surface is shaped to focus the electron beam. Thus even where only one hole is employed the electron beam may be focussed. Each point of the surface around the mouth of the hole and at its edge may be thought of as directing components of the electron beam normal to the surface at respective points. Thus by providing the surface with a certain configuration, for example a convex shape or advantageously a frusto-conical configuration, with the hole being centrally located, a desired degree of focussing may be obtained. For example, the electron beam may be focussed to a point or it could be focussed merely enough to aid in further collimation of the electron beam.

Generally the, or each hole in a cathode member is blind, and preferably of circular cross-section.

Preferably the insulating material insulating surfaces of the cathode member, or plurality of cathode members, from the gas filling is glass, but where the cathode member, or members, is of an anodisable metal, such as aluminium or titanium, the insulating material may be anodisation.

Preferably the cathode and anode members are of Kovar but other metals or alloys may be used, such as aluminum, copper or tungsten, or molybdenum, tantalum or other refractory metals for high current use.

Generally the envelope is of glass or quartz.

Preferably the side wall and base surfaces of each hole is entirely free of a covering of electrically insulating material.

A number of gases, or mixture of gases, may be used for the gas filling including helium and/or argon and/or deuterium and/or neon. The hole size and voltages applied are related to the type of gas employed. Typically, hole sizes for argon are 0.2 to 0.1 of the size of those for helium, giving the possibility of more compact devices.

Preferably the gas filling is at a pressure of between 0.5 and 2.5 mB.

Normally the higher voltage utilised to address the anode and cathode members is from 1 to 5 kV and preferably between 1 and 2.5 kV.

BRIEF DESCRIPTION OF THE DRAWINGS

The invention is further described by way of example with reference to the accompanying drawings in which:

FIG. 4 illustrates, in perspective, part of the device of FIG. 13;

DESCRIPTION OF THE PREFERRED EMBODIMENTS

Figure 1:
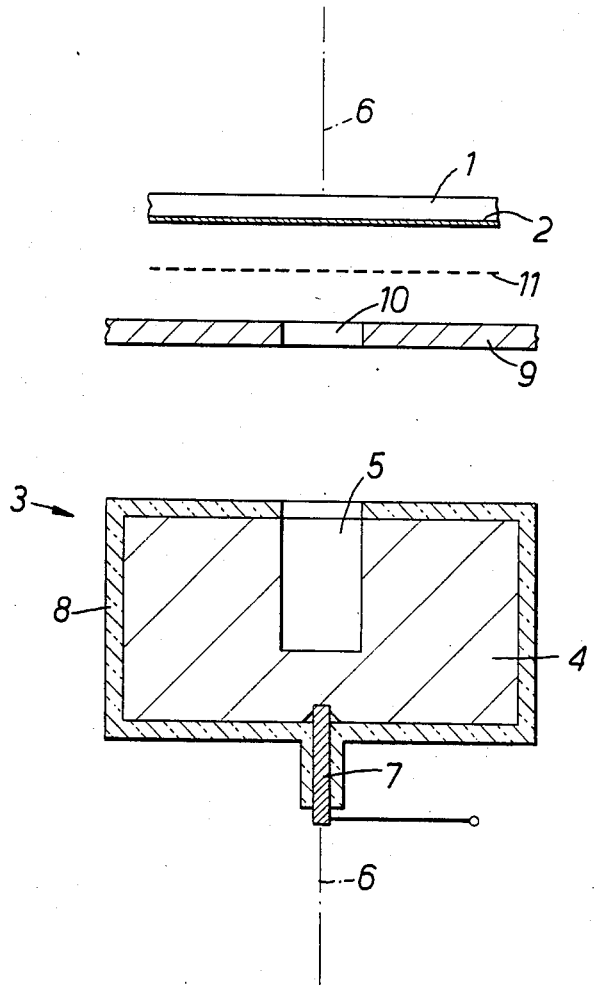
FIG. 1 is a schematic cross-section of one simple electronic display device in accordance with the present invention.

Referring to FIG. 1, there is shown a device comprising a quartz envelope of which only one portion 1 is shown. The envelope portion 1 is provided as a faceplate having on its interior a layer 2 of phosphor material similar to that used in conventional cathode ray display tubes. Associated with the phosphor layer 2 is a transparent metal layer (not shown but somewhat akin to the transparent metal layer forming part of the screen of a conventional cathode ray tube) between the layer 2 and the faceplate. The faceplate formed by the portion 1 of the envelope of the device is transparent.

Within the envelope and at the end thereof opposite to the faceplate portion 1, is a cathode member 3 which comprises a block 4 of Kovar having a blind hole 5 formed therein, in this case by drilling coaxially with the axis of cylindrical symmetry 6 of the device. The open mouth of the hole 5 faces the phosphor layer 2. In the base of the block 4, adjacent the blind end of the hole 5, a connecting pin 7 is inserted so as to enable electrical connection to be made to the Kovar block 4.

All of the external surfaces of the Kovar cathode block 4, with the exception of the wall and base surfaces of the blind hole 5, which would otherwise be exposed to a gas filling within the envelope of the device are covered by electrically insulating material represented at 8. In this example, the insulating material 8 is glass.

Between the cathode 3 and the phosphor layer 2 is an anode electrode 9 which has a circular hole 10 passing therethrough. Circular hole 10 is coaxially aligned with the blind hole 5 within the Kovar block 4.

It will be noted that the cathode 3 is devoid of a heater as such, or any electron emissive cathode material, such as barium.

The envelope of the tube is filled with helium at a pressure of between 0.2 and 10 mB.

As so far described the device is in its simplest form. For the moment it will be assumed that grid 11, shown between the anode electrode 9 and the phosphor layer 2, is absent.

Provided that the dimensions of the cathode and anode holes 5 and 10 and the spacing of the anode 9 to the cathode 3 is suitably chosen, a type of electrical discharge will be established between the anode 9 and the cathode 3 which results in the formation of an electron beam along the axis 6 of the coaxially aligned anode and cathode holes when a potential difference in the range of from several hundred volts to several thousand volts is established between the anode 9 and the block 4 of cathode 3. Within limits, the electron beam acquires energy approximately equal to the anode to cathode potential difference and so extends into the region beyond the anode hole 10 to impinge, finally, upon the phosphor layer 2 thus exciting it.

Thus, in operation, whenever a potential as aforesaid is established between anode 9 and block 4 of cathode 3, the resulting electron beam causes a spot to appear on the screen 1 due to excitation of the phosphor layer 2. Whilst the aforementioned dimensions and spacing may be arrived at empirically, in the particular example illustrated in FIG. 1, the cathode and anode holes were of 5 mm diameter. With a gas filling of helium at a pressure of 2 mB and a potential difference between anode 9 and cathode 3 of approximately 1.5 kV, the device was found to operate with a spacing between the plane of the anode 9 and the surface of the phosphor layer 2 of up to a few centimeters, and a spacing between the anode 9 and the cathode 3 of at least 3 mm. With the above-mentioned potential difference of 1.5 kV, the current drawn from the cathode was of the order of 15 mA.

Reverting to the aforementioned grid 11, by introducing a control grid, modulation of the intensity or energy of the electron beam arriving at the surface of the phosphor layer 2 may be achieved by varying a potential applied to the grid 11. Alternatively, or additionally, varying the potential between the anode 9 and the cathode 3 will produce or enhance a modulation effect but, of course, it is much less convenient to apply modulation at high potential.

Figure 2:
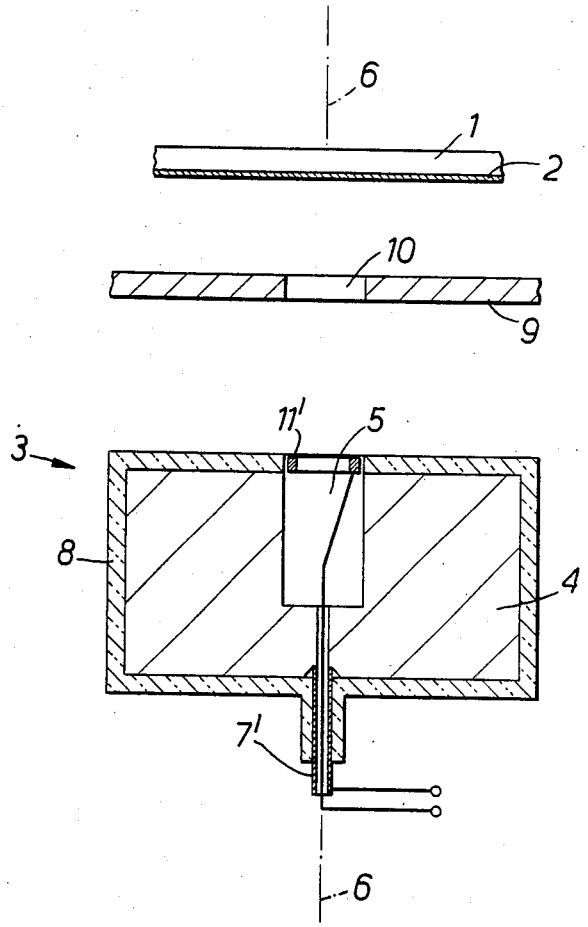
FIGS. 2 and 3 illustrate modifications of the device illustrated in FIG. 1, like references being used for like parts in FIGS. 1 to 3.

Referring to FIG. 2, the essential difference between the device shown in FIG. 2 and the device shown in FIG. 1 resides in the fact that a mesh grid such as 11 in FIG. 1 is not provided betwen the anode 9 and the phosphor layer 2. Instead, a ring grid 11′ is provided within the mouth of the blind hole 5 in the Kovar block 4. Electrical connection is made to the ring grid 11′ by means of a connector passing out through the base of the Kovar block 4. In fact, instead of a pin 7 making contact with the block 4 the contact, here referenced 7′, is cylindrical with the connecting lead for the grid 11′ passing coaxially therethrough in insulated fashion. Although not shown in FIG. 2, insulating material would be provided to support the connecting lead for the grid 11′ within the cylindrical connector 7′.

Figure 3:
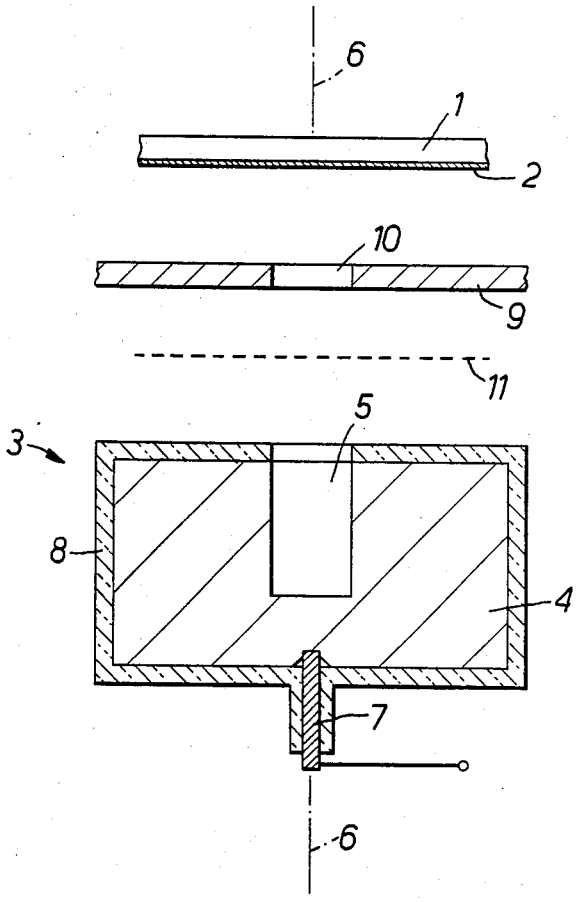

Referring to FIG. 3, in this case, compared to FIG. 1, the position of the grid 11 is changed. Instead of providing this between anode 9 and the phosphor layer 2 it is provided between the anode 9 and the cathode 3. In some cases this may be preferred since a relatively lower voltage is required compared to that required with the grid in the position shown in FIG. 1.

Figure 4:
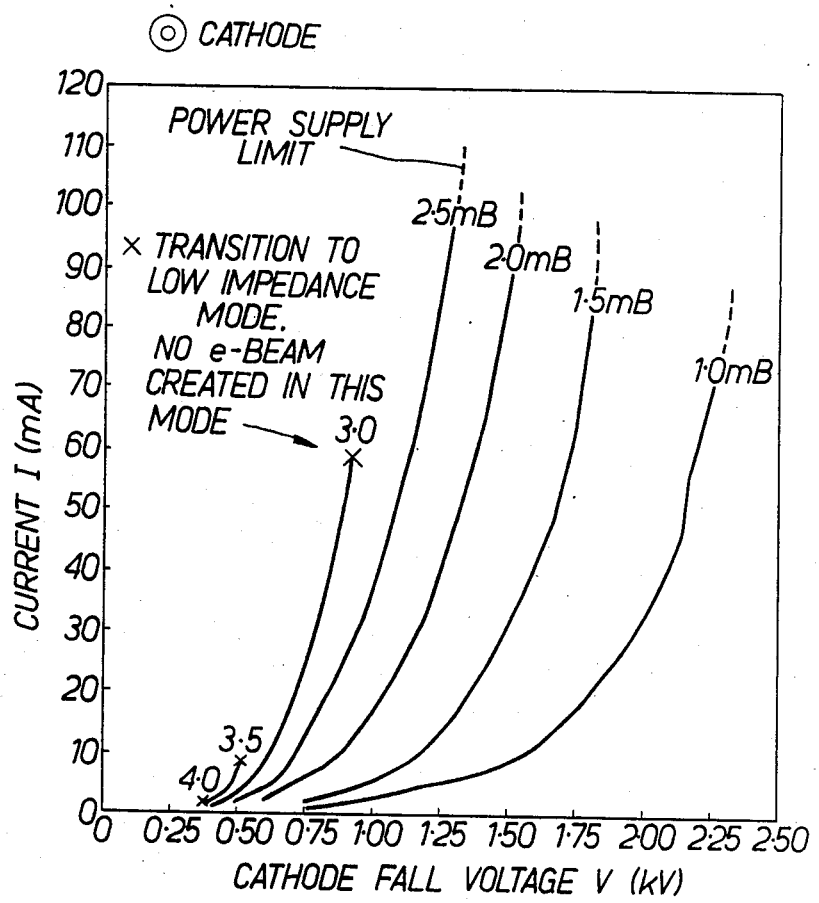
FIGS. 4 and 5 are explanatory graphs.

The graph of FIG. 4 shows the relationship between beam current I and cathode fall voltage V (i.e. the voltage applied between anode and cathode) for different gas filling pressures, for a device as described above having cathode and anode holes of 5 mm in diameter.

In any of the embodiments described above with reference to FIGS. 1, 2 and 3, instead of a single cathode hole, and a single anode hole a plurality of blind holes may be provided in the Kovar block 4 with each cathode hole being coaxially aligned with a corresponding hole passing through the anode member 9. Typically in such a case, the holes will be arranged in a ring formation, with or without cathode and anode holes oncentre. The effect achieved using a plurality of cathode and anode holes in a simple device as illustrated in FIGS. 1 to 3, is that the areas of excitation thus created in the phosphor layer 2 tend to merge to produce a larger illuminated spot (or other prescribed pattern as determined by the pattern of holes on the faceplate 1) than would otherwise be the case.

Figure 5:
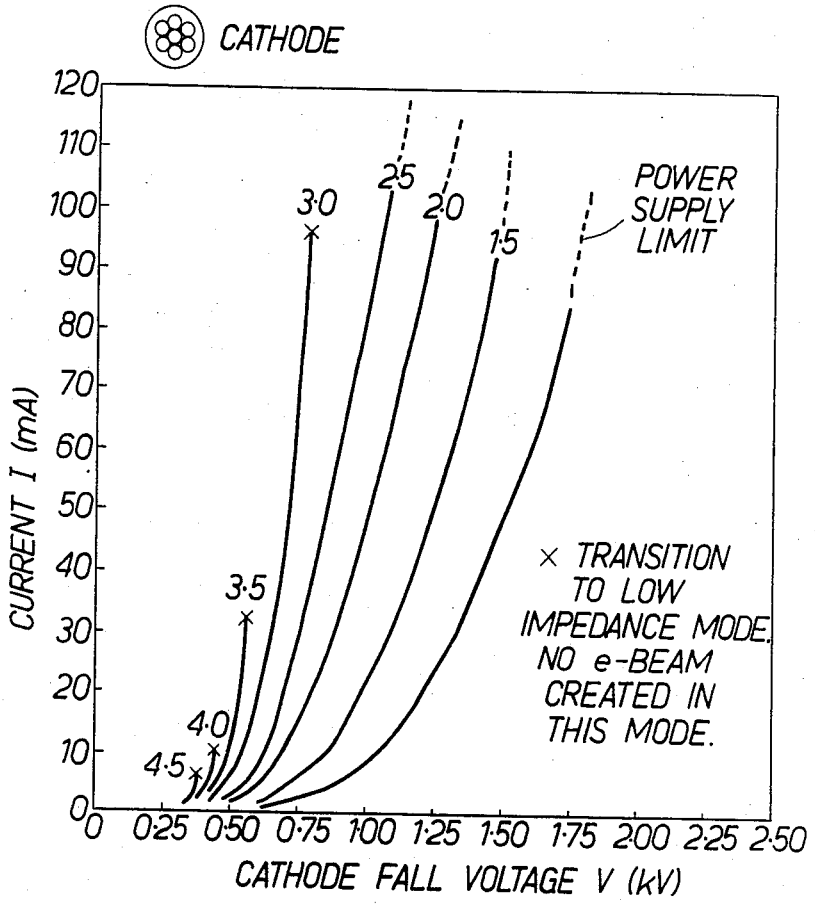

The graph of FIG. 5 shows parameters for this last-mentioned case corresponding to those shown in the graph of FIG. 4 for this embodiment shown in FIG. 1.

One application for a device as described above is in large area displays such as those sometimes found in public places in order to impart information, e.g. in airport terminals or sports areas. By arranging devices such as those described above in rows and columns and addressing individual devices appropriately, letters and words—and even graphics—may be produced.

Figure 6:
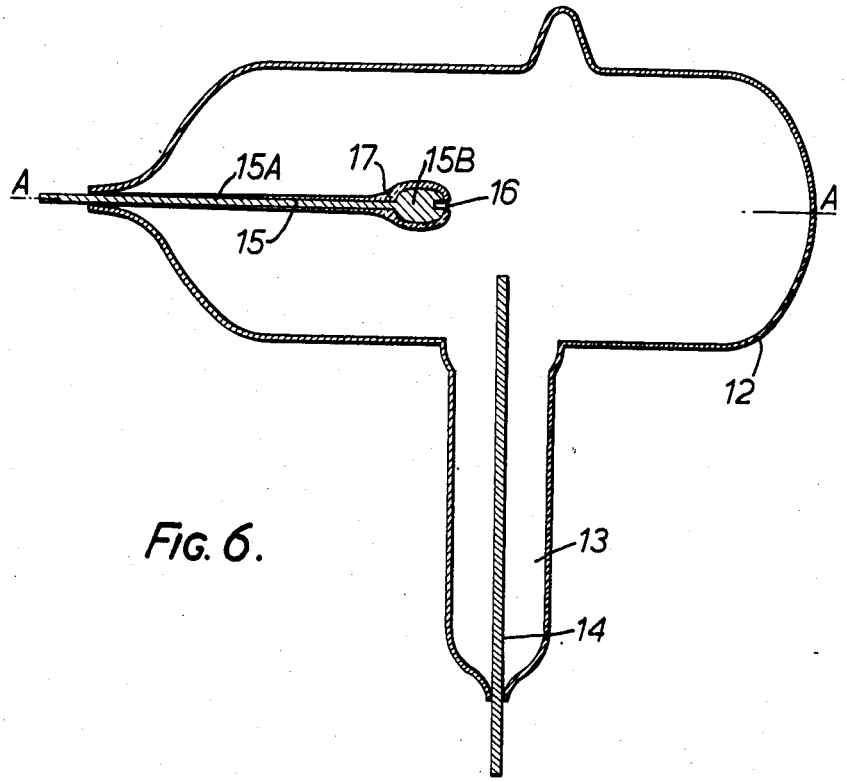
FIG. 6 shows, in longitudinal cross-section, another example of an electron beam device in accordance with the present invention.

Referring to FIG. 6, another device in accordance with the invention includes a glass envelope 12 which is of generally circular cross-section and has a transversely extending side-arm 13 about mid-way along its length. An anode member 14 extends through the end wall of the side-arm 13 and into the main part of the volume enclosed by the envelope 12.

A cathode member 15 passes through an end wall of the envelope 12. It has a stem portion 15A and an enlarged end 15B with a blind hole 16 of circular cross-section in its front surface. All of the surfaces of the cathode member 15 contained within the envelope 12, except for the side wall and base surfaces of the hole 16, are coated with a layer of glass 17. The envelope 12 contains helium at a pressure of 2 mB.

In operation, a potential difference of about 1 kV is applied across the anode and cathode members 14 and 15 and an electron beam is formed along the axis A—A of the hole 16.

The envelope 12 has a length of about 7 cm and a diameter of about 3.5 cm.

The anode and cathode members 14 and 15 are separated by approximately 1 cm in the axial direction and 0.5 cm in the transverse direction. The diameter of the hole 16 is 5 mm, with a depth (i.e. axial length) of 3 mm.

Figure 8:
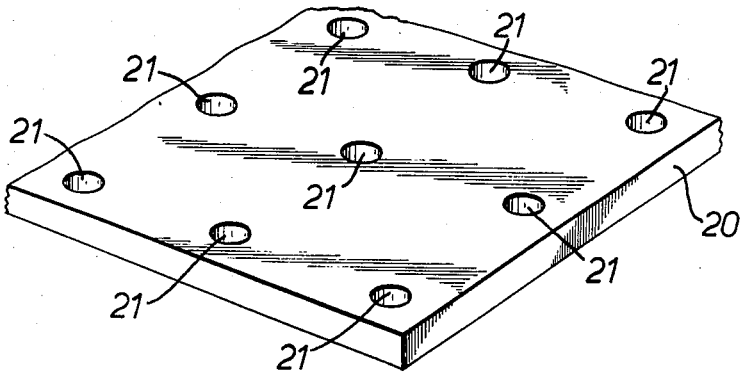
FIG. 8 illustrates, in perspective, part of the insulating slab 20 of FIG. 7.
Figure 9:
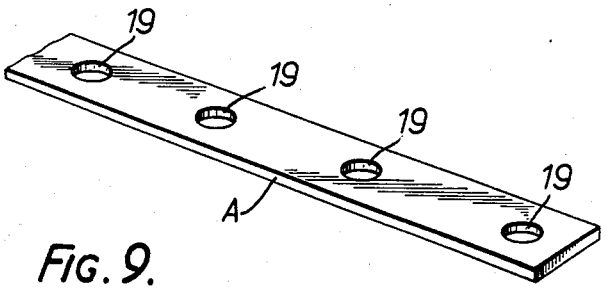
FIG. 9 illustrates, part broken away, one elongate anode member A used in the device of FIG. 7.
Figure 10:
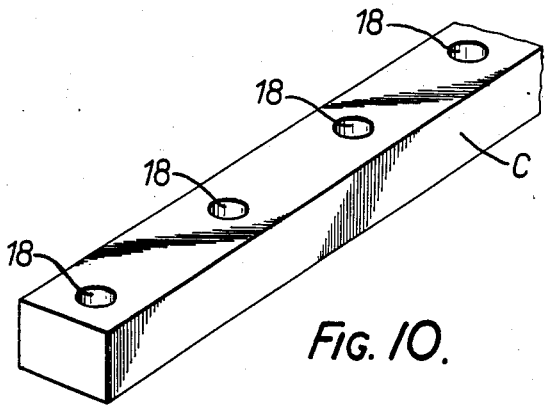
FIG. 10 illustrates, part broken away, one elongate cathode member C utilised in FIG. 7.

Referring to FIGS. 7 to 11 a display device comprises a plurality of elongate cathode members C1 to C4 arranged parallel to one another to form a grid. Each cathode member, as shown in FIG. 10, comprises a bar of Kovar having at regular intervals along its length blind holes 18. The holes 18 extend into the same planar surface of the cathode member. Each cathode member is provided with an electrical connector (not shown) by means of which it may be individually addressed.

Superimposed above the grid of cathode members is a grid of parallel elongate anode members A1 to A5 each of which consists of a bar of Kovar having a series of holes 19 passing therethrough from one planar face to its opposite planar face as illustrated in FIG. 9. The pitch of the holes 19 in an anode member corresponds to the spacing between the cathode members in the cathode grid and the spacing of the anode members in the anode grid corresponds to the pitch of the cathode holes 18 in a cathode member so that each cathode hole 18 is aligned with an anode hole 19 at the crossing point of the anode and cathode conductors in which those particular holes appear.

Figure 11:
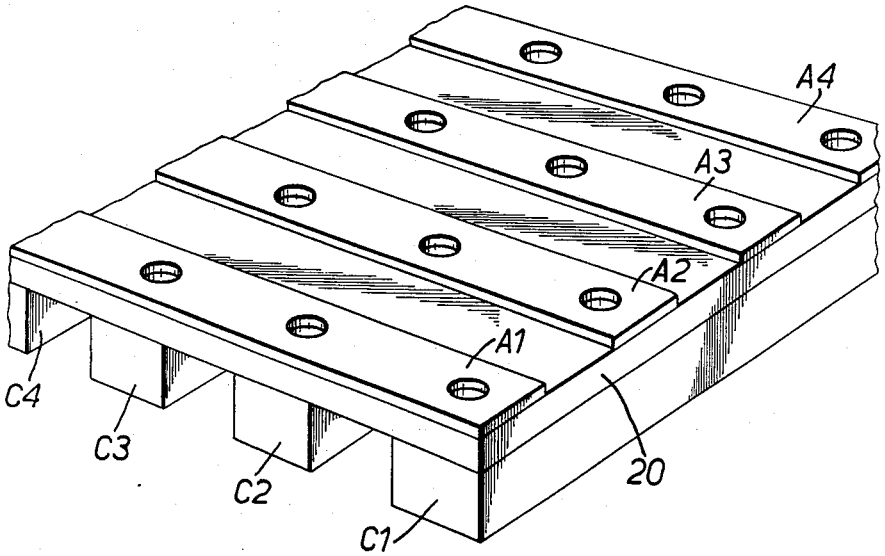
FIG. 11 is a perspective view, part broken away, of an assembly of cathode and anode members with the slab of insulating material shown in FIG. 8 sandwiched therebetween.

Sandwiched between the grid of cathode members and the grid of anode members is a slab 20 of glass which has rows and columns of holes 21 therein extending from one major planar face to its opposite major planar face, as illustrated in FIG. 8. The rows and columns of holes are spaced such that when the slab is sandwiched between the grid of cathode members and the grid of anode members, as shown in FIG. 11, each aligned cathode and anode hole at the crossing point of an anode and cathode member is also aligned with a hole in the slab of insulating material 20. Thus, the holes 21 in the insulating slab 20 permit communication between appropriate ones of the cathode and anode holes 18 and 19 but impede communication between each cathode hole and other than the anode holes with which it is directly aligned. Thus the tendency for so-called "long path" discharged to take place is reduced.

Superimposed over the grid of anode members is a phosphor screen comprising of a layer of phosphor material 22 on the inside of part of an enclosing envelope which is formed as a faceplate 23. Associated with the layer 22 of phosphor material is a transparent layer of conductive material (somewhat akin to the transparent metal layer of the phosphor screen of a conventional cathode ray tube device) between the phosphor layer 22 and the faceplate 23. The envelope in this case is of glass and encloses the anode and cathode members together, of course, with the interposed slab of insulating material 20.

Figure 7:
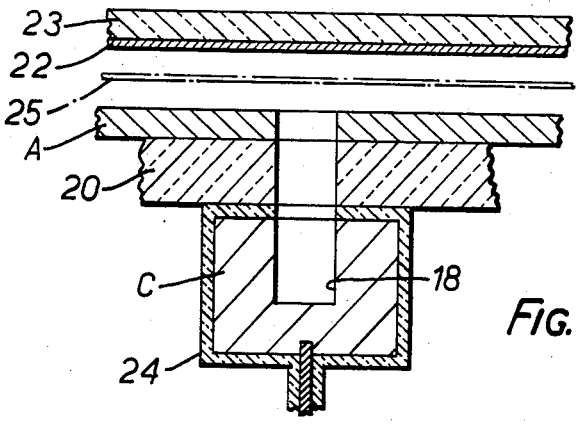
FIG. 7 is a schematic cross-section through a flat screen cathode ray display device in accordance with the present invention.

The envelope has a gas filling of helium and, as illustrated only in FIG. 7, each cathode member C is entirely covered with an electrically isolating layer 24 of glass, except within the holes 18. Thus, save for the wall and base surfaces of the holes 18 all surfaces of the cathode members which would otherwise be exposed to the helium gas filling are isolated therefrom. In fact, save for the interior surfaces of the holes 18 as aforesaid, all surfaces at cathode potential are so isolated from the gas filling. In this particular case the wall and base surfaces of the holes 18 are entirely free from glass. In this particular example the cathode and anode holes 18 and 21 are of circular cross-section with a diameter of 5 mm. The helium gas filling is at a pressure of 2 mB. The distance separating the grid of cathode members from the grid of anode members (i.e. the thickness of the slab 20) is a few millimeters whilst the distance separating the grid of anode members from the phosphor layer 22 is in the region of 0.5 to 2 cm.

Figure 12:
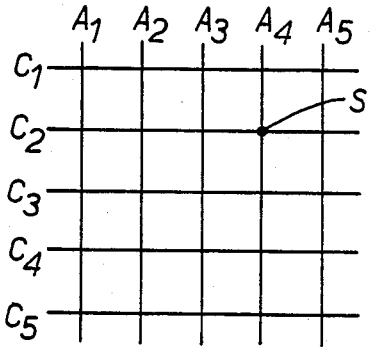
FIG. 12 is a schematic diagram illustrating the operation of the device illustrated in FIGS. 7 to 11.

If now, and referring particularly to FIG. 12, a 1.5 kV potential difference is established between cathode member C2 and anode member A4 than an electron beam will be formed in the region of the crossing point of members C2 and A4 which beam extends from out of the mouth of the cathode hole 18 at the crossing point through the corresponding hole in the insulating slab 20 to penetrate through the corresponding anode hole 19 in anode members A4 and impinge upon the phosphor screen to form a spot as represented at S in FIG. 12. By addressing different combinations of anode members and cathode members corresponding spots may be caused to appear on the screen at any of the crossing points and by suitably changing the combination of crossing points selected an animated display may be achieved.

No mention has so far been made of grid 25 shown in FIG. 7 as located between the grid of anode members A and the phosphor layer 22. The purpose of this grid, if provided, is to modulate the intensity or energy of the electron beams arriving at the phosphor.

Alternatively, with or without the grid 25, the overall intensity or energy of the electrons beams may be modulated or adjusted by appropriate alterations to the anode to cathode discharge current as determined by the voltage applied between the cathode and anode members.

Figure 13:
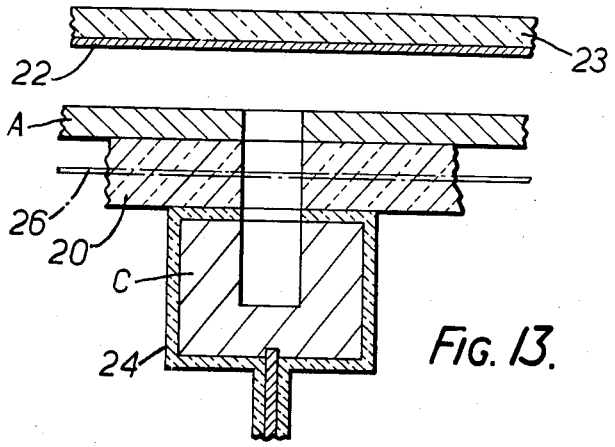
FIG. 13 is a schematic cross-section through another flat screen cathode ray device in accordance with the present invention.
Figure 14:
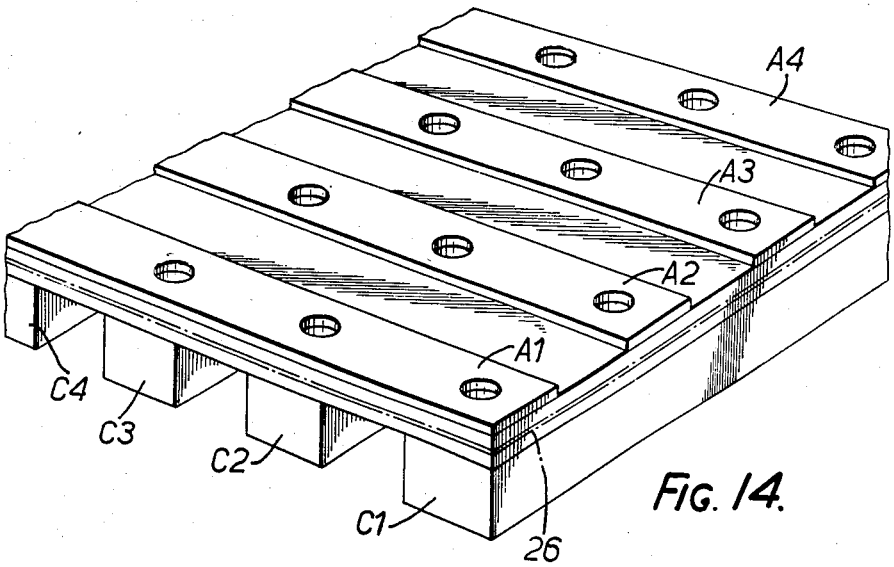
Figure 15:
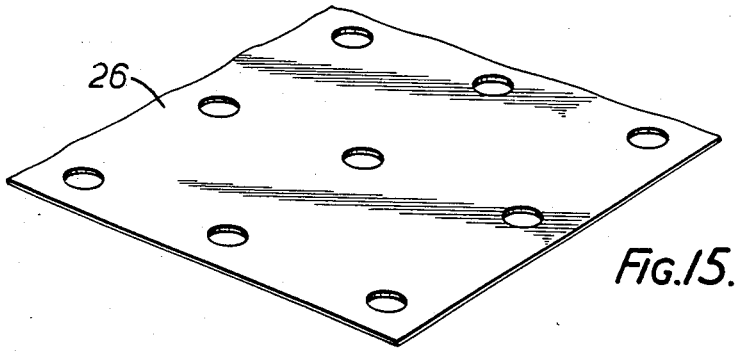
FIG. 15 illustrates, in perspective, part of the device of FIG. 13; with like references being used for like parts.

In another embodiment a grid 26 is embedded in the slab 20, as shown in FIGS. 13 and 14, and may comprise a gauze or as metal plate having holes which correspond to the anode and cathode holes, as illustrated in FIG. 15.

It will be noted particularly the absence of any form of conventional electron gun. No cathode heaters are employed in the device illustrated, the cathodes being cold cathodes, and no cathode material such as barium is employed.

Figure 16:
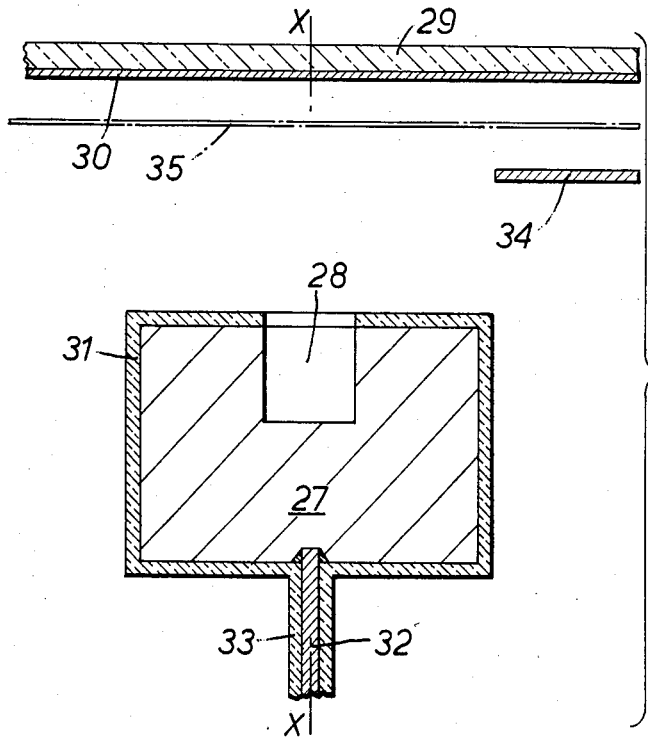
FIG. 16 is a schematic cross-section of a display device in accordance with the invention.

With reference to FIG. 16, another embodiment of the invention includes a cathode member 27 of Kovar having a hole 28 of about 5 mm diameter in its front surface and being enclosed in a glass envelope 29 which also contains helium gas at a pressure of about 2 mB and has a layer of phosphor on its inner surface to form a screen 30. The surfaces of the cathode member 27, except the side wall and base of the hole 28, are covered in a glass layer 31, which electrically insulates the cathode member 27 from the helium gas filling. Electrical connection to the cathode member 27 is made via a pin 32 which is sheathed with a layer 33 of glass.

An anode member 34 is located between the front surface of the cathode member 27 and the phosphor screen 30, being about 2 cm from the cathode member 27, and 2 cm from the screen 30. The anode member 34 is also offset from the axis X—X of the hole 28, being about 2 cm to the right as shown.

When a 1.5 kV potential difference is established between the cathode member 27 and the anode member 34, an electron beam is formed along the axis X—X of the hole, even though the anode member 34 is offset from that axis. The electron beam impinges on the phosphor screen 30 to form a spot.

The intensity of the spot may be varied by modulating the voltage applied to a grid electrode 35, shown in this embodiment to be positioned between the screen 30 and the anode member 34, although it could be located between the anode and cathode members 34 and 27.

Figure 17:
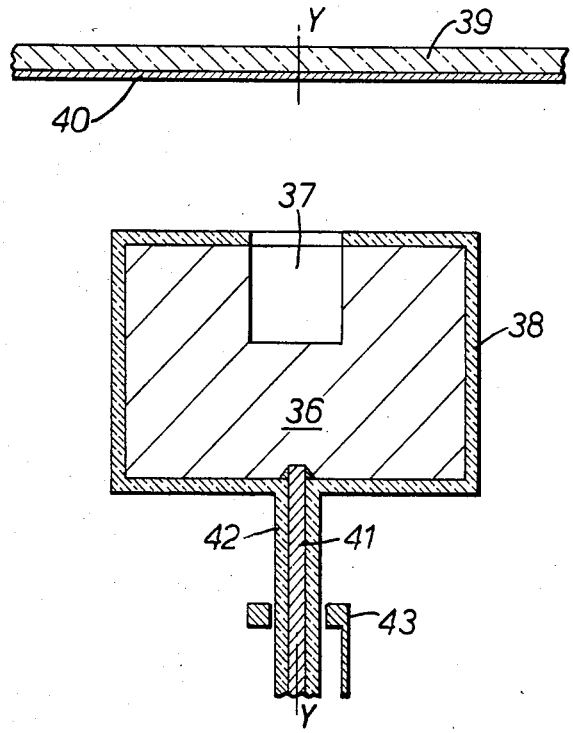
FIG. 17 is a schematic cross-section of another display device in accordance with the invention.

A further embodiment of the invention is illustrated schematically in FIG. 17. A cathode member 36 of Kovar has a hole 37 in its front surface and is coated with an electrically insulating layer of glass 38. The cathode member 36 is contained within a glass envelope 39 having on its inner surface a layer of phosphor which acts as a screen 40, and enclosing helium gas at 2 mB pressure. The cathode member 36 is electrically connected via a pin 41, which is also coated in glass 42, forming a stem. In this embodiment a Kovar anode member 43 is located behind the front surface of the cathode member 36 and is positioned co-axially with it about the pin 41.

When in operation a potential difference of 1.5 kV is applied between the cathode and anode members 36 and 43, an electron beam forms along the axis Y—Y of the hole 37 and impinges on the screen 40.

As in the previously described embodiments, a modulating grid may also be included, and/or modulation may be carried out by varying the potential difference applied.

The hole 37 has a diameter of about 5 mm and the front surface of the cathode member 36 may be between a few millimeters and a few centimeters from the screen 40.

Figure 18:
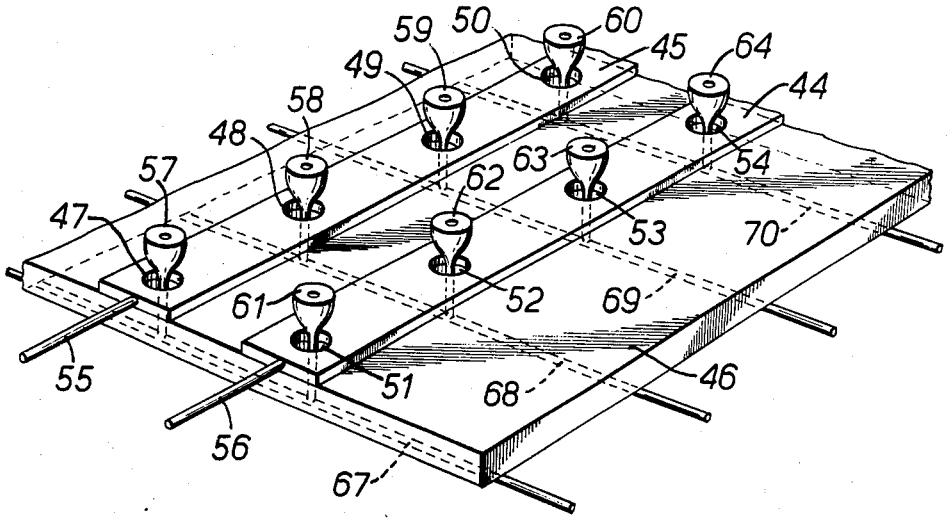
FIG. 18 is a perspective view, part broken away.
Figure 19:
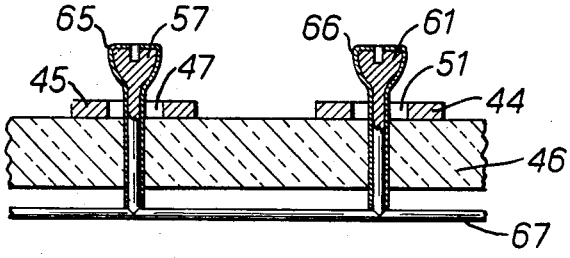
FIG. 19 a cross-sectional view of yet another device in accordance with the invention.

Yet another embodiment of the invention is now described with reference to FIGS. 18 and 19. A plurality of Kovar strips, only two of which 44 and 45 are shown, are arranged parallel to each other on a glass slab 46. Each of the strips has a plurality of apertures through it, only four of which, 47, 48, 49 and 50; 51, 52, 53 and 54 are shown for each strip. Each strip forms an anode member, electrical signals being applied to them via rods 55 and 56.

Cathode members 57 to 64 are of Kovar and have stems extending through the apertures in the strips 44 and 45, there being one cathode member to each aperture, and passing through the glass slab 46. The surfaces of each cathode member, including the connecting pin comprising its stem, are coated in glass layers 65 and 66 except for the side wall and base of the single hole in each one's front surface.

The ends of the cathode members 57 to 64 on the side of the glass slab 46 other than the anode strips 44 and 45 are connected via rods 67, 68, 69 and 70, such that one cathode member associated with one strip is electrically connected to a cathode member associated with each of the other strips, giving a crossing relationship between the cathode and anode members. Thus, by applying a potential difference between a suitable cathode member and anode strip, an electron beam may be formed in front of that cathode member.

By placing the structure within an envelope filled with helium at 2 mB pressure, and having a phosphor screen on its inner surface, a display may be produced.

The front surfaces of the cathode members 57 to 64 may be as litle as 5 mm from the surface of the screen, and a potential difference between the anode and cathode members of 1.5 kV would be required.

Figure 20:
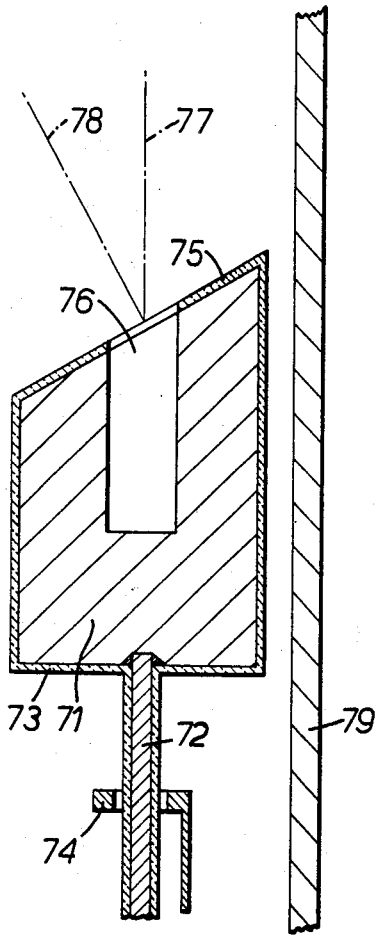
FIG. 20 shows a longitudinal section of a further apparatus in accordance with the invention.

With reference to FIG. 20, a thorated tungsten cathode member 71 has a stem 72 via which electrical connection is made, and is covered with a layer 73 of electrically insulating glass which also extends to the stem 72. An anode member 74 surrounds and is coaxial with the stem 72.

The cathode member 71 has a front surface 75 in which is formed a blind hole 76 of circular cross-section, being 5 mm deep and having a diameter of about 1.5 mm, and having surfaces which are free of the layer 73 of glass. The front surface 73 is inclined with respect to the hole 76 such that the longitudinal axis of the hole 76, shown as broken line 77, is oblique to the normal 78 of the front surface 75 at that point, the angle between them being about 30°.

The cathode and anode arrangement is enclosed within a glass envelope which also contains a gas filling of deuterium at about 2 mB pressure.

In operation, when a suitably high voltage, say 2 kV, is established between the anode and the cathode members 74 and 71, an electron beam is formed extensive in a direction away from the hole 76 and normal to the front surface 75. If, as illustrated a wall 79, which might be for example the wall of the envelope or some other obstruction, is present, this could restrict the space available to the arrangement. By giving a suitable incline to the front surface 75 the hole 76 can have a depth which might not be possible if its longitudinal axis 77 were arranged to be parallel to the normal 78 to the front surface 75.

Figure 21:
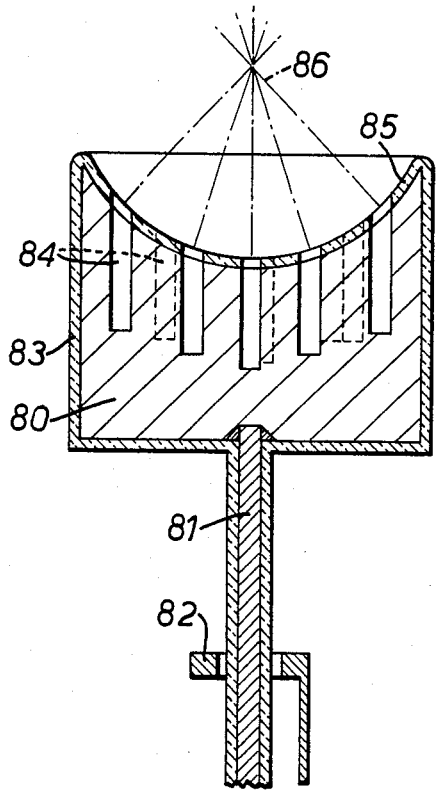
FIG. 21 is a longitudinal section of another apparatus in accordance with the invention.

With reference to FIG. 21, a thorated tungsten cathode member 80 is connected to stem 81 and is contained within an envelope (not shown) together with a deuterium gas filling at about 2 mB pressure and an anode member 82, which is coaxial with and surrounds the stem 81.

The cathode member 80 and stem 81 are coated with a layer 83 of glass which electrically insulates them from the deuterium gas filling.

A plurality of holes 84 are formed in a front surface 85 of the cathode member 80, each of them being of circular cross-section with a diameter of about 1.5 mm and a depth of 5 mm and having surfaces which are free of the layer 83 of glass. The front surface 85 is curved, for example, it may be parabolically or spherically shaped, rather than the flat surface 75 shown in FIG. 20.

In operation, when a voltage of about 2 kV is applied between the cathode and anode members 80 and 82 a plurality of electron beams are formed extensive normal to the front surface 85 at and in diretions away from respective holes, and come to a focus at a point 86 which is located according to the configuration of the front surface 85.

Although the holes 84 are illustrated as being disposed mutually parallel, they could be arranged in some other way, since their attitude does not affect the directions of the electrons beams which are formed during operation.

Apparatus according to the invention in which the surface is curved to produce such focussing might find application in an electron beam welder, for example, in which case the piece being welded may also be for example contained within the envelope. It might also find application in the production of a point source of soft X-rays, having a wavelength of about $6.10^{-10}$ m, for use in spectroscopy for example, or to generate a point source of incandescent black body radiation.

Figure 22:
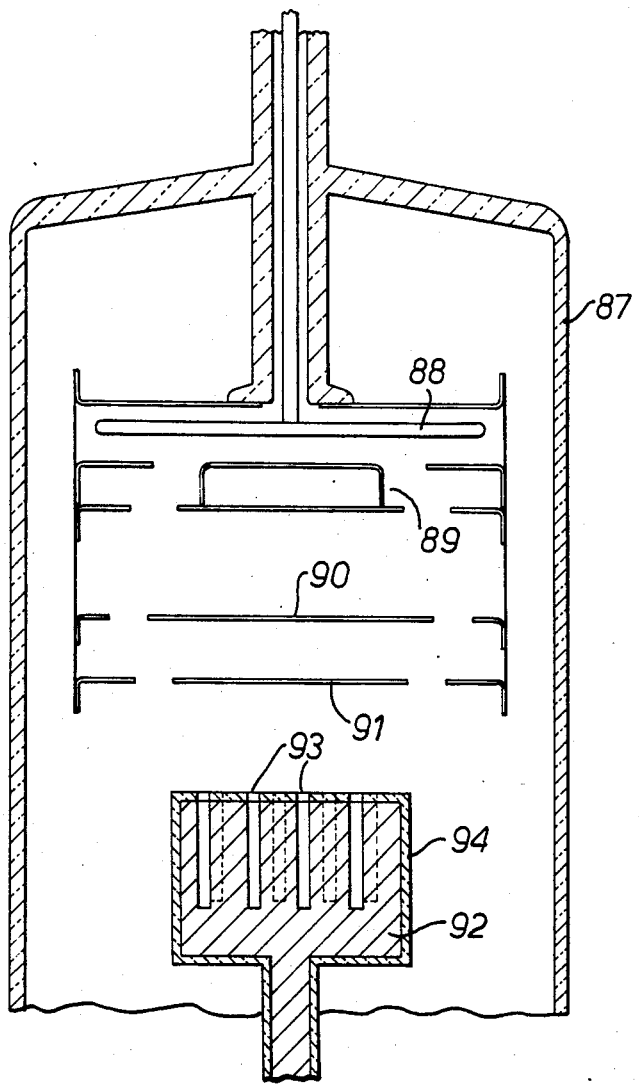
FIG. 22 illustrates a thyratron in accordance with the invention.

With reference to FIG. 22, a thyratron in accordance with the invention includes a glass envelope 87, containing a gas filling, an anode 88, a screen grid 89 and control grids 90 and 91, such as might be found in a conventional thyratron. However, instead of the conventionally provided heated cathode, the cathode comprises a cathode member 92 of tungsten having a plurality of holes 93 in itsfront surface, facing the anode 88. The surface of the cathode member 92 is entirely covered with a glass layer 94 except for the walls and bases of the holes 93. When the thyratron is required to become conducting a suitably high voltage is applied between the anode 88 and the cathode member 92 such that an electron beam is formed extensive in a direction away from each hole. The gas filling becomes ionized and a conduction path is established between the anode 88 and cathode member 92.

Figure 23:
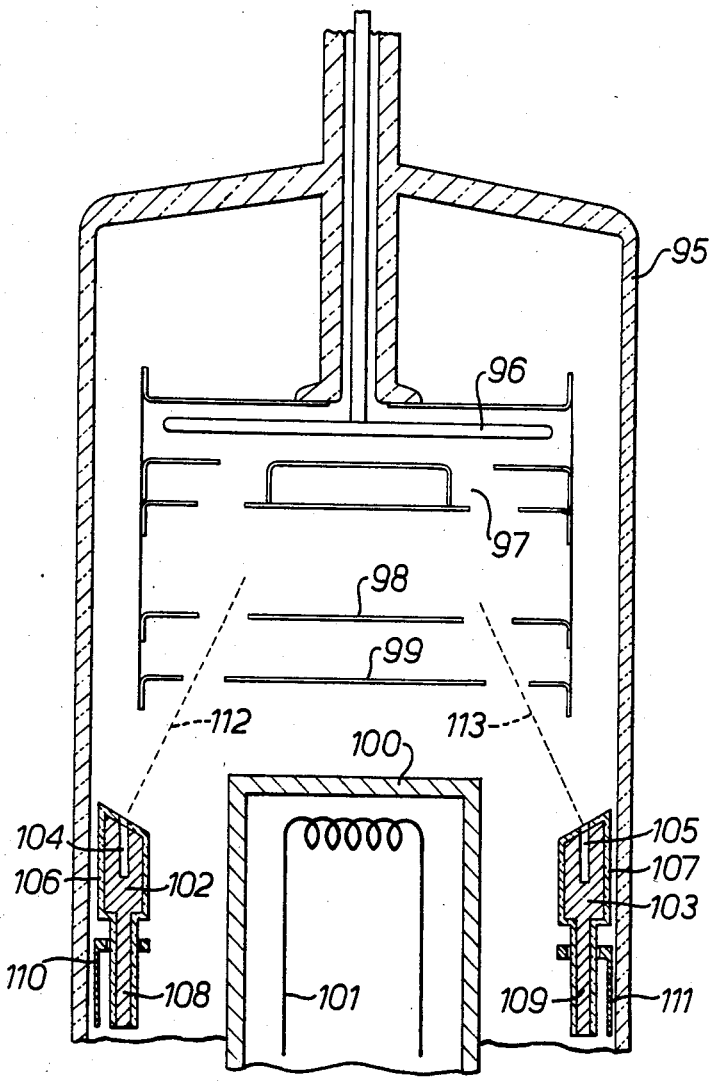
FIG. 23 illustrates another thyratron in accordance with the invention.

Referring to FIG. 23, another thyratron in accordance with the invention includes a glass envelope 95 containing a gas filling, an anode 96, a screen grid 97 and control grids 98 and 99. It also includes a conventional heated cathode, comprising a hollow cylinder 100 of thermionic material and a heater filament 101.

Two cathode members 102 and 103 are located within the glass envelope 95. Each has a hole 104 and 105 in its front surface and is coated with a glass layer 106 and 107. The longitudinal axes of the holes 104 and 105 are oblique to the front surfaces of the cathode members 102 and 103. The cathode members 102 and 103 also have stem portions 108 and 109 which are surrounded by coaxial anode members 110 and 111 respectively.

During operation of the thyratron, the thermionic material 100 is heated by the heater filament 101 causing electrons to be emitted from its surface. The emitted electrons ionize that part of the gas filling between the controls grids 98 and 99 and the cathode to establish a primary discharge. Then conventionally, to trigger the thyratron, a positive voltage pulse is applied to the control grids 98 and 99, allowing the discharge to penetrate through them to initiate the main discharge, and thus to render the thyratron conducting. However, in addition to this, a voltage may be applied between the anode members 102 and 103 and the cathode members 110 and 111 respectively, such that electrons beams are formed extensive of the holes 104 and 105 and normal to the front surfaces of the cathode members 102 and 103, their path being shown by broken lines 112 and 113. These beams may be formed simultaneously with, or shortly before or after, the application of the voltage pulse to the control grids 98 and 99. The beams are arranged to pass through apertures in the control grids 98 and 99 and penetrate into the volume beyond them, to ionize the gas filling.

The cathode members could be located elsewhere within the envelope 95 if it is desired to promote ionization in other regions of the thyratron, and of course only one, or more than two cathode members could be used.

Figure 24:
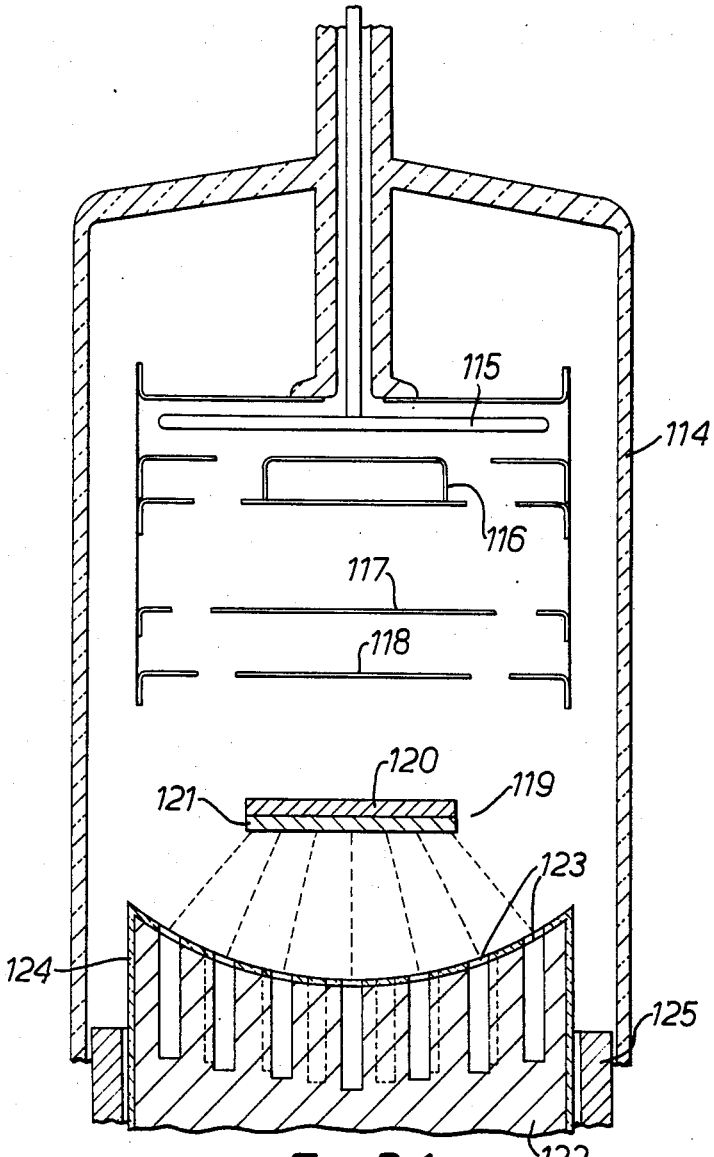
FIG. 24 shows yet another thyratron in accordance with the invention.

With reference to FIG. 24, another thyratron includes a glass envelope 114, gas filling, an anode 115, a screen grid 116 and control grids 117 and 118. The thyratron includes a thermionic cathode 119 having thermionic material 120 carried by a substrate 121 of high thermal conductivity which may be nickel, for example. A cathode member 122 of tungsten is positioned on the substrate side of the cathode 120. The cathode member 122 has a plurality of holes 123 in its front surface which is concave. The surface of the cathode member 122, except for the walls and bases of the holes 123, are covered with a layer 124 of glass. An anode member 125 surrounds the cathode member 122.

In operation, a voltage is applied between the anode member 125 and the cathode member 122 such that a beam of electrons is formed extensive of each hole. The curved surface of the block 122 gives a focussing effect, and the electrons are directed to impinge on the substrate 121, their kinetic energy being converted into heat. Heat is conducted to the thermionic material 120 causing electrons to be emitted to produce ionization of the gas filling.

Figure 25:
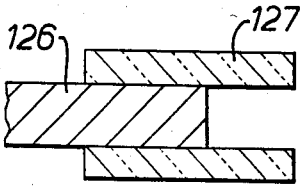
FIG. 25 illustrates a cathode member in accordance with the invention.

With reference to FIG. 25, a cathode member is formed by inserting a tungsten cylindrical rod 126 into a hollow tube 127 of an electrically insulating material, such as a ceramic or galss.

Figure 26:
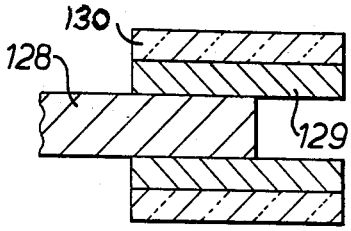
FIG. 26 shows another cathode member.

FIG. 26 illustrates another cathode member in which a tungsten rod 128 is inserted into a hollow metal tube 129, which may also be of tungsten, and a ceramic tube 130 is fitted over the metal tube 129. Any metal surfaces which would be exposed in use to a gas filling may then be covered with an insulating layer. By employing cathode members of this type no drilling is required, as it is with those previously described.

Figure 27:
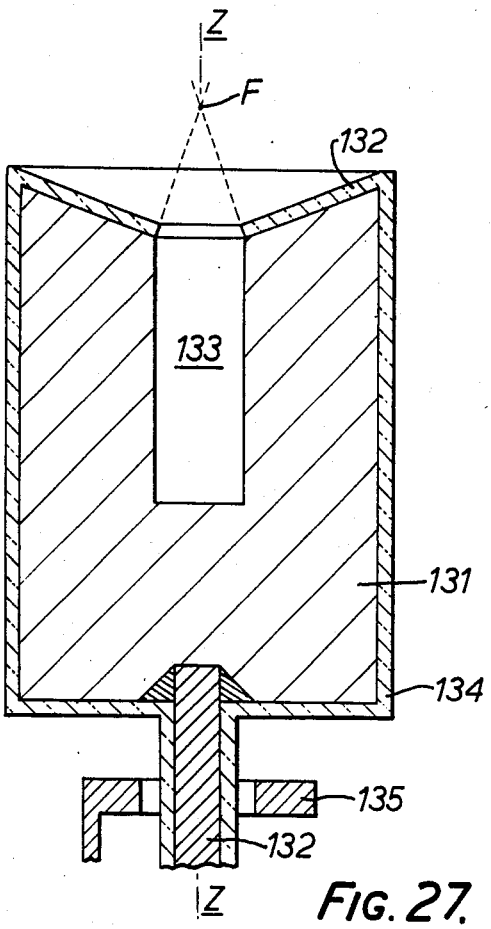
FIG. 27 illustrates another device in accordance with the invention.

With reference to FIG. 27, a device in accordance with the invention comprises within an envelope (not shown) which also contains a gas filling, a cylindrical cathode member 131 having a stem portion 132 via which electrical connection is made to the cathode member 131. The cathode member 131 has a front surface 132 of circular transverse cross-section which is of a 'dished' or frusto-conical configuration, the front surface being inclined such that the length of the cathode member 131 along its axis Z—Z increases from its centre to its circumference. Other surface configuration may of course be employed if desired. A hole 133 is located in the centre of the front surface 132 and is coaxial with axis Z—Z of the cathode member 131. The surfaces of the cathode member 131 and the stem portion 132 are covered with a layer 134 of electrically insulating glass, and an anode member 135 surrounds and is coaxial with the stem portion 132.

When a voltage is applied between the cathode member 131 and the anode member 135 an electron beam is formed extensive of the hole 133. The beam is formed in a direction normal to the front surface 132. Since at the edge of the hole 133 the front surface 132 is inclined, components of the beam at points around the edge of the hole 133 are directed towards the axis Z—Z, such that the beam is brought to a focus F. The position of the focus F depends on the amount of inclination of the front surface. Such a device may thus produce a lens-like action, without the need for electron lens.

If the front surface is flat then a beam is produced which, although it is highly collimated, tends to diverge to some extent because of, for example, scattering processes. By using a front surface having a small degree of dishing, this tendency may be counteracted.

We claim:

1. Apparatus for forming an electron beam, comprising: an envelope having a gas-filling of a predetermined pressure therein; an anode member; a cathode member, said anode and cathode members being disposed within said envelope with a predetermined position relative to one another, said cathode member being of an electrically conductive material and having a front surface, said cathode member including an electrically insulating material covering at least substantially its whole surface, except for a part of said front surface, which would otherwise be exposed to said gas filling; and means for applying a voltage between said anode member and said cathode member, said part of said front surface having dimensions such that, in combination with the relative position of said anode and cathode members and the predetermined pressure of said gas filling, and upon the application of a suitably high voltage between said anode member and said cathode members, a collimated electron beam is formed extensive in a direction away from said part of said front surface.

2. Apparatus for forming an electron beam, comprising: an envelope having a gas filling therein of a predetermined pressure, an anode member; a cathode member, said anode and cathode members being disposed within said envelope with a predetermined position relative to one another, said cathode member being of an electrically conductive material and having a surface including a front surface provided with a hole, said cathode member including an electrically insulating material covering at least substantially the whole of its surface which would otherwise be exposed to the gas filling within said envelope, except for the surface of said hole; and means for applying a voltage between said anode and cathode members, said hole having dimensions such that, in combination with the relative position of said anode and cathode members and the predetermined pressure of said gas filling, and upon the application of a suitable high voltage between said anode member and said cathode members, a collimated electron beam is formed extensive in a direction away from said hole.

3. Apparatus as claimed in claim 2, and wherein said anode member is located in front of the front surface of said cathode member.

4. Apparatus as claimed in claim 3 and including a control grid electrode through which in operation the electron beam passes.

5. Apparatus as claimed in claim 3, wherein said cathode member comprises a plurality of elongate cathode members arranged in a grid formation, said anode member comprises a plurality of elongate anode members arranged in a grid formation, with said grid of anode members being superimposed over said grid of cathode members, but spaced therefrom, and said anode members being in crossing relationship with said cathode members to form a matrix, said hole constitutes a series of holes in each said cathode member entering into its front surface and facing said grid of anode members, each of said anode members having a series of holes passing therethrough, with each hole in an anode member aligned with a hole in a different one of the cathode members, and all surfaces of said cathode members, except for the surfaces within said holes in said cathode members, which would otherwise be exposed to said gas filling are isolated therefrom by electrically insulating material, wherein the dimensions of said holes, the relative positions of said cathode members to said anode members and the predetermined pressure of said gas filling, are such that by applying a high potential between one of said anode members and one of said cathode members a collimated electron beam is formed at the crossing point of said last-mentioned two members, said electron beam being extensive in the space between the mouth of the hole in said one cathode member at said crossing point and said one anode member, said beam being arranged to penetrate through the corresponding hole in said one anode member.

6. Apparatus as claimed in claim 5, and further comprising insulating material interposed between said grid of cathode members and said grid of anode members, said insulating material having passages therethrough aligned with said holes in said cathode and anode members to permit communication between one cathode hole and a corresponding anode hole, and impede communication between that one cathode hole and any other anode hole.

7. Apparatus as claimed in claim 6, and wherein said interposed insulating material comprises a slab having holes extending between its major surfaces and forming said passages.

8. Apparatus as claimed in claim 5, and further including a control grid electrode located on the side of said grid of anode members remote from said grid of cathode members.

9. Apparatus as claimed in claim 5, and further including a control grid electrode located between said grid of cathode members and said grid of anode members.

10. Apparatus as claimed in claim 9, and further including insulating material interposed between said grid of cathode members and said grid of anode members, said insulating material having passages therethrough aligned with said holes in said cathode and anode members to permit communication between one cathode hole and a corresponding anode hole, and impede communication between that one cathode hole and any other anode hole, said grid electrode being embedded in said interposed insulating material.

11. Apparatus as claimed in claim 2, and wherein said anode member is located to one side of the axis of the electron beam formed in operation.

12. Apparatus as claimed in claim 2, and wherein said anode member is located behind said front surface of said cathode member.

13. Apparatus as claimed in claim 12, and wherein said anode member is co-axial with said cathode member.

14. Apparatus as claimed in claim 12, and further including a grid electrode through which in operation the electron beam passes.

15. Apparatus as claimed in claim 12, and wherein said anode member comprises a plurality of elongate anode members each having apertures therein; and said cathode member comprises a plurality of stemmed cathode members each having a hole in the front surface thereof and arranged such that its stem extends through one of said apertures, such that each anode member is located behind the front surfaces of cathode members whose stems pass through apertures in said anode member, whereby by applying a high potential between an anode member and one of the cathode members extending through an aperture therein a collimated electron beam is formed extensive in a direction away from the hole in said one of said cathode members.

16. Apparatus as claimed in claim 15, and further including connector means electrically connecting a cathode member extending through an aperture in one anode member to another cathode member extending through an aperture in another anode member.

17. Apparatus as claimed in claim 16, and wherein said connector means is disposed to define a space relative to said anode members, and further including electrically insulating material disposed in said space.

18. Apparatus as claimed in any claim 2, and further including a phosphor layer arranged so that when an electron beam is formed it impinges upon a spot upon said layer whereby to excite the same.

19. Apparatus as claimed in claim 18 and wherein said envelope has a portion formed as a faceplate on the interior of which said phosphor layer is provided.

20. A video signal reproducing apparatus including apparatus as claimed in claim 2.

21. Cathode ray tube apparatus, comprising: a plurality of elongate cathode members arranged in a grid formation; a plurality of elongate anode members arranged in a grid formation, with said grid of anode members being superimposed over said grid of cathode members and having a predetermined spacing therefrom, said anode members being in crossing relationship with said cathode members to form a matrix, each of said cathode members having a surface facing said grid of another members and being provided with a plurality of holes entering into said surface, and each of said anode members having a plurality of holes passing therethrough, with each hole in an anode member aligned with a hole in a different one of the cathode members; a phosphor screen superimposed over said grid of anode members on the side thereof remote from said grid of cathode members; an envelope containing a gas filling of predetermined pressure, said envelope enclosing said grid formations; and means for applying a voltage between said anode members and said cathode members; said cathode members including electrically insulating material covering all surfaces of said cathode members, except for surfaces within said holes in said cathode members, which would otherwise be exposed to said gas filling, the holes in said cathode members having dimensions such that, in combination with the predetermined spacing of said anode and cathode members and the predetermined pressure of said gas filling, and upon applying a high potential between one of said anode members and one of said cathode members, a collimated electron beam is formed at the crossing point of said last-mentioned two members, said electron beam being extensive in the space between the mouth of the hole in the cathode member at said crossing point and said anode member, said beam penetrating through the corresponding hole in said one anode member to impinge upon a spot upon said phosphor screen to excite the same.

22. Apparatus as claimed in claim 2, and wherein the said hole has a longitudinal axis that is oblique to the normal of said front surface, and the electron beam is formed normal to said front surface at said hole.

23. Apparatus as claimed in claim 22, and wherein said hole comprises a plurality of holes in said front surface, at least one of said holes having a longitudinal axis oblique to the normal of said front surface at that hole, such that upon the application of said suitability high voltage, electron beams are formed extensive normal to said front surface and in a direction away from respective holes.

24. Apparatus as claimed in claim 23 and wherein said front surface is curved.

25. Apparatus as claimed in claim 24 and wherein said front surface is curved such that the electron beams formed are focussed at a point.

26. Apparatus for forming electron beams comprising, an anode member; a cathode member of electrically conductive material and having a front surface which is curved; an envelope containing a gas filling of predetermined pressure, said anode and cathode members being disposed in said envelope with a predetermined spacing relative to one another; and means for applying a voltage between said anode and cathode members, said cathode member including an electrically insulating material covering at least substantially the whole of the surface of said cathode member, except for a plurality of discrete parts of said front surface, which would otherwise be exposed to said gas filling, said discrete parts having dimensions such that, in combination with the predetermined spacing of said anode and cathode members and the predetermined pressure of said gas filling, and upon the application of a suitably high voltage between said anode member and said cathode member, collimated electron beams are formed extensive normal to said front surface at and in a direction away from said respective parts.

27. Apparatus as claimed in claim 26, and wherein said front surface is curved such that the electron beams formed are focussed at a point.

28. Apparatus as claimed in claim 26, and wherein said anode member co-axially surrounds and is behind said front surface of said cathode member.

29. Apparatus as claimed in claim 2, and further including a viewable screen and a layer of phosphor material disposed on said screen, said screen being arranged such that upon the application of said suitably high voltage the electron beam impinges upon said phosphor layer and excites the same.

30. Apparatus as claimed in claim 29, and wherein said anode member has an aperture therein and is located between said cathode member and said phosphor layer, said electron beam being arranged to penetrate through said aperture.

31. Apparatus as claimed in claim 30, and wherein the hole in said cathode member and said aperture in said anode member are coaxially aligned.

32. Apparatus as claimed in claim 29, and wherein said envelope has a portion formed as a faceplate upon the inner surface of which said phosphor layer is provided.

33. Apparatus as claimed in claim 29 and further including a modulating grid arranged to affect the strength or intensity of the electron beam impinging upon said phosphor layer.

34. Apparatus as claimed in claim 33, and wherein said modulating grid is a perforated grid or gauze provided between said anode member and said phosphor layer.

35. Apparatus as claimed in claim 33, and wherein said modulating grid is a perforated grid or gauze provided between said anode member and said cathode member.

36. Apparatus as claimed in claim 33, and wherein said modulating grid comprises a ring grid provided within the mouth of said hole in said cathode member.

37. Apparatus as claimed in claim 36, and further including an electrical connection for said grid taken out, in insulated fashion, through said cathode member in a direction away from said anode member.

38. Apparatus as claimed in claim 29, wherein said cathode member has a base, and further including an electrical connection to said cathode member provided for by means of a first electrical connector connected to the base of said cathode member.

39. Apparatus as claimed in claim 38, and wherein said first electrical connector is preferably in the form of a hollow cylinder.

40. Apparatus as claimed in claim 39, and further including a modulating grid in the form of a ring grid provided within the mouth of said hole in said cathode member; an electrical connection for said grid taken out, in insulated fashion, through said cathode member in a direction away from said anode member and a second electrical connector for said grid passing through said hollow cylinder.

41. Apparatus as claimed in claim 29, wherein said hole comprises a plurality of holes provided in said cathode member; and further including a corresponding plurality of holes provided in said anode member.

42. Display apparatus, comprising: a viewable screen having a layer of phosphor material thereon; a metallic cathode member disposed remote from said phosphor layer and having a front surface provided with a hole therein; an apertured anode electrode disposed between said cathode member and said phosphor layer and having a predetermined spacing relative to said cathode; an envelope containing a gas filling at a predetermined pressure, said envelope enclosing said screen and said anode and cathode members; and means for applying a voltage between said anode and cathode members, said cathode member including an electrically insulating material covering at least substantially the whole of its surface, except for the surface of said hole, which would otherwise be exposed to the gas filling within said envelope, the hole having dimensions such that, in combination with the predetermined spacing of said anode member relative to said cathode member and the predetermined pressure of said gas filling, and upon the application of a suitably high, voltage between said anode member and said cathode member, a collimated electron beam is formed extensive in the space between the mouth of the hole in said cathode member and said anode member, and is arranged to penetrate through the aperture in said anode member to impinge upon said phosphor layer and excite the same.

43. Thyratron apparatus comprising: an anode member; a cathode member of electrically conductive material and having a front surface provided with a hole therein, said anode having a predetermined spacing relative to said cathode; an envelope containing a gas filling of a predetermined pressure, said envelope enclosing said anode and cathode members; and means for applying a voltage between said anode and cathode members, said cathode member including an electrically insulating material covering at least substantially the whole of the surface of said cathode member, except within said hole, which would otherwise be exposed to the gas filling within said envelope, said hole having dimensions such that, in combination with the predetermined spacing of said anode member relative to said cathode member and the predetermined gas pressure, and upon the application of a suitably high voltage between said anode member and said cathode member, a collimated electron beam is formed extensive in a direction away from said hole.

44. Apparatus as claimed in claim 43 and wherein said cathode member has a plurality of holes in the front surface thereof, such that upon application of a suitably high voltage a plurality of collimated electron beams are formed extensive in a direction away from said respective holes.

45. Apparatus as claimed in claim 44, and wherein said front surface is curved.

46. Apparatus as claimed in claim 45, and wherein at least one of said holes has a longitudinal axis oblique to the normal of said front surface at said one hole.

47. Apparatus as claimed in claim 43, and further including thermionic material arranged for being heated by said electron beam.

48. Apparatus as claimed in claim 43, and wherein, when said electron beam is formed, it is arranged to ionize said gas filling in a localised region.

49. Apparatus as claimed in claim 48, and wherein said hole has a longitudinal axis oblique to the normal of said front surface at said hole.

50. Apparatus as claimed in claim 2, and wherein said front surface is shaped to focus said electron beam.

51. Apparatus as claimed in claim 50, and wherein said front surface is substantially frusto-conical, and said hole is centrally located at said front surface.

52. Apparatus as claimed in claim 2, and wherein said front surface is substantially frusto-conical, and said hole is centrally located at said front surface.

53. Apparatus as claimed in claim 2, and wherein said hole in said cathode member is blind.

54. Apparatus as claimed in claim 2, and wherein said hole in said cathode member is of circular cross-section.

55. Apparatus as claimed in claim 2, and wherein said hole has a side wall and a base in said cathode member which are entirely free of a covering of electrically insulating material.

56. Apparatus as claimed in claim 2, and wherein said insulating material comprises glass.

57. Apparatus as claimed in claim 2, and wherein said cathode member comprises Kovar.

58. Apparatus as claimed in claim 2, and wherein said anode member comprises Kovar.

59. Apparatus as claimed in claim 2, and wherein said envelope comprises glass.

60. Apparatus as claimed in claim 2, and wherein the said gas filling comprises helium.

61. Apparatus as claimed in claim 2, and wherein said gas filling is at a pressure of between 0.5 and 2.5 mB.

62. Apparatus as claimed in claim 2, and wherein the high voltage applied between the anode member and the cathode member is between 1 and 2.5 kV.

63. Apparatus as claimed in claim 2, and wherein said cathode member comprises thorated tungsten.

* * * * *